US011655615B1

(12) United States Patent
Abe et al.

(10) Patent No.: US 11,655,615 B1
(45) Date of Patent: May 23, 2023

(54) WORK MACHINE AND CONTROL METHOD FOR WORK MACHINE

(71) Applicant: Kubota Corporation, Osaka (JP)

(72) Inventors: Daiki Abe, Sakai (JP); Ryota Hamamoto, Sakai (JP); Jun Tomita, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/071,619

(22) Filed: Nov. 30, 2022

(30) Foreign Application Priority Data

Feb. 8, 2022 (JP) ..... JP2022-018063

(51) Int. Cl.
*E02F 9/22* (2006.01)
*E02F 3/42* (2006.01)
*E02F 3/34* (2006.01)

(52) U.S. Cl.
CPC ..... *E02F 9/2285* (2013.01); *E02F 3/422* (2013.01); *E02F 3/3414* (2013.01)

(58) Field of Classification Search
CPC ..... E02F 9/2225; E02F 3/3414; E02F 3/422; E02F 9/2285
See application file for complete search history.

(56) References Cited

U.S. PATENT DOCUMENTS

2018/0112375 A1* 4/2018 Greer ..... E02F 9/2225
2019/0101138 A1* 4/2019 Fukuda ..... F15B 11/16
2020/0048868 A1* 2/2020 Nishimoto ..... E02F 9/2228

FOREIGN PATENT DOCUMENTS

JP 6919479 B2 4/2019
WO WO-2015098033 A1 * 7/2015 ..... B62D 5/062

* cited by examiner

*Primary Examiner* — Abiy Teka
(74) *Attorney, Agent, or Firm* — Mori & Ward, LLP

(57) ABSTRACT

A work machine includes a first oil passage connecting a first hydraulic pump and a first chamber of a bucket cylinder, a fourth oil passage connecting an arm control valve and a fourth chamber of an arm cylinder, a bypass oil passage connecting the fourth oil passage and the first oil passage, and a switching mechanism configured to control connection/disconnection of the fourth oil passage to/from the first oil passage via the bypass oil passage. Circuitry is configured to determine whether an uptilt operation to raise the arm and to tilt the bucket downward has been performed based on outputs of an arm operation detection sensor and a bucket operation detection sensor, and to control the switching mechanism to connect the fourth oil passage and the first oil passage when it is determined that the uptilt operation has been performed.

20 Claims, 4 Drawing Sheets

WORK MACHINE AND CONTROL METHOD FOR WORK MACHINE

CROSS-REFERENCE TO RELATED APPLICATIONS

The present application claims priority under 35 U. S. C. § 119 to Japanese Patent Application No. 2022-018063, filed Feb. 8, 2022. The contents of this application are incorporated herein by reference in their entirety.

BACKGROUND OF THE INVENTION

Field of the Invention

The present invention relates to a work machine and a control method for the work machine.

Discussion of the Background

Japanese Patent No. 6919479 discloses a work machine including a hydraulic system for performing horizontal control for preventing dropping of a load by changing a tilt angle of a bucket in accordance with an arm elevation when elevating the arm.

SUMMARY OF THE INVENTION

According to one aspect of the present invention, a work machine includes a bucket including a bucket proximal end and a bucket distal end opposite to the bucket proximal end, an arm including an arm distal end that swingably supports the bucket proximal end and an arm proximal end opposite to the arm distal end, a vehicle body swingably supporting the arm proximal end, a bucket cylinder including a first chamber into which hydraulic fluid flows when the bucket distal end is tilted downward, and a second chamber into which hydraulic fluid flows when the bucket distal end is tilted upward, an arm cylinder including a third chamber into which hydraulic fluid flows when the arm distal end is raised, and a fourth chamber into which hydraulic fluid flows when the arm distal end is lowered, a first hydraulic pump configured to discharge hydraulic fluid to the bucket cylinder and the arm cylinder, a first oil passage connecting the first hydraulic pump and the first chamber of the bucket cylinder, a bucket control valve provided in the first oil passage and having a bucket control pilot port, the bucket control valve being configured to control hydraulic fluid supplied to the first chamber and the second chamber according to hydraulic pressure of the pilot oil applied to the bucket control pilot port, a second oil passage connecting the bucket control valve and the second chamber, a third oil passage connecting the first hydraulic pump and the third chamber of the arm cylinder, an arm control valve provided in the third oil passage and having an arm control pilot port, the arm control valve being configured to control hydraulic fluid supplied to the third chamber and the fourth chamber according to hydraulic pressure of the pilot oil applied to the arm control pilot port, a fourth oil passage connecting the arm control valve and the fourth chamber, a second hydraulic pump configured to discharge pilot oil to control the arm control valve and the bucket control valve, a first pilot oil passage connecting the arm control pilot port and the second hydraulic pump, an arm pilot control valve provided in the first pilot oil passage and configured to control the hydraulic pressure of the pilot oil applied to the arm control pilot port based on an operation amount of an arm input member operated to raise and lower the arm, an arm operation detection sensor configured to detect operation of the arm input member, a second pilot oil passage connecting the bucket control pilot port and the second hydraulic pump; a bucket pilot control valve provided in the second pilot oil passage and configured to control the hydraulic pressure of the pilot oil applied to the bucket control pilot port based on an operation amount of a bucket input member operated to swing the bucket, a bucket operation detection sensor to detect operation of the bucket input member, a bypass oil passage connecting the fourth oil passage to the first oil passage, a switching mechanism configured to control connection of the fourth oil passage to the first oil passage via the bypass oil passage and disconnection of the fourth oil passage to the first oil passage via the bypass oil passage; and circuitry configured to determine whether an uptilt operation to raise the arm and to tilt the bucket downward has been performed based on an output of the arm operation detection sensor and an output of the bucket operation detection sensor, control the switching mechanism to connect the fourth oil passage to the first oil passage when it is determined that the uptilt operation has been performed.

According to another aspect of the present invention, a control method for a work machine including: sending hydraulic fluid from a first hydraulic pump to a first chamber of a bucket cylinder via a first oil passage to tilt a bucket distal end of a bucket downward; controlling a bucket control valve provided in the first oil passage to connect a part of the first oil passage from the first hydraulic pump to a bucket control valve with a second oil passage connecting the bucket control valve and a second chamber of the bucket cylinder to send the hydraulic fluid from the first hydraulic pump to the second chamber of the bucket cylinder to tilt the bucket distal end upward; sending the hydraulic fluid from the first hydraulic pump to a third chamber of an arm cylinder via a third oil passage to raise an arm distal end of an arm that swingably supports a bucket proximal end of the bucket opposite to the bucket distal end; controlling an arm control valve provided in the third oil passage to connect a part of the third oil passage from the first hydraulic pump to the arm control valve with a fourth oil passage connecting the arm control valve and a fourth chamber of the arm cylinder to send the hydraulic fluid from the first hydraulic pump to the fourth chamber of the arm cylinder to lower the arm distal end; detecting an input of a first operation to raise the arm to an arm input member configured to be operated to raise and lower the arm; detecting an input of a second operation to tilt the bucket downward to a bucket input member configured to be operated to swing the bucket; and sending, when the first operation and the second operation are detected, the hydraulic fluid to the first chamber through the first oil passage to control a switching mechanism to connect the first oil passage with the fourth oil passage through a bypass oil passage to send hydraulic fluid in the fourth chamber to the first chamber.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
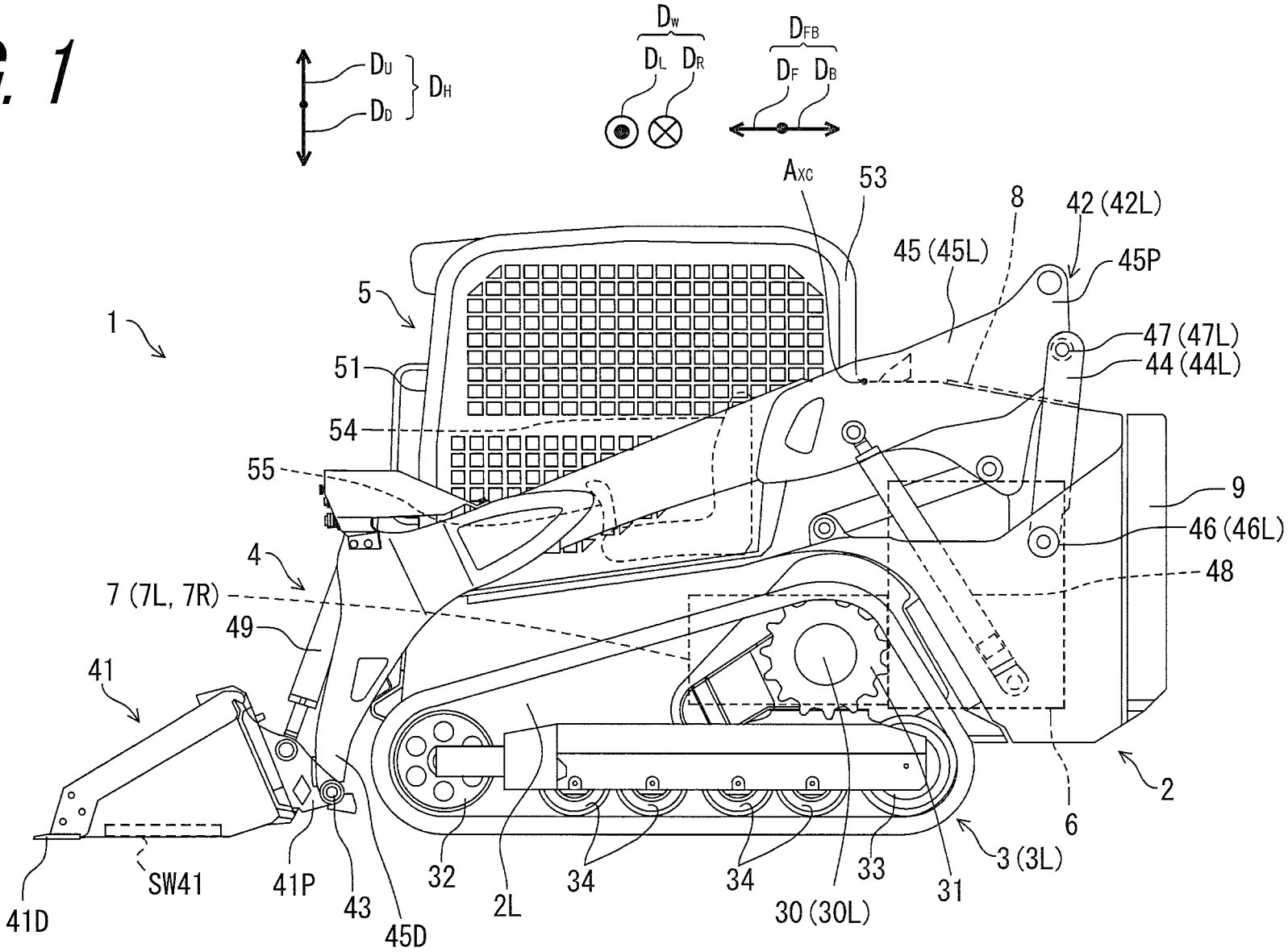
FIG. 1 is a side view of a work machine.

Embodiments of the present invention will be described below with reference to the accompanying drawings. Similar reference numerals indicate corresponding or identical components in the drawings.

Figure 2:
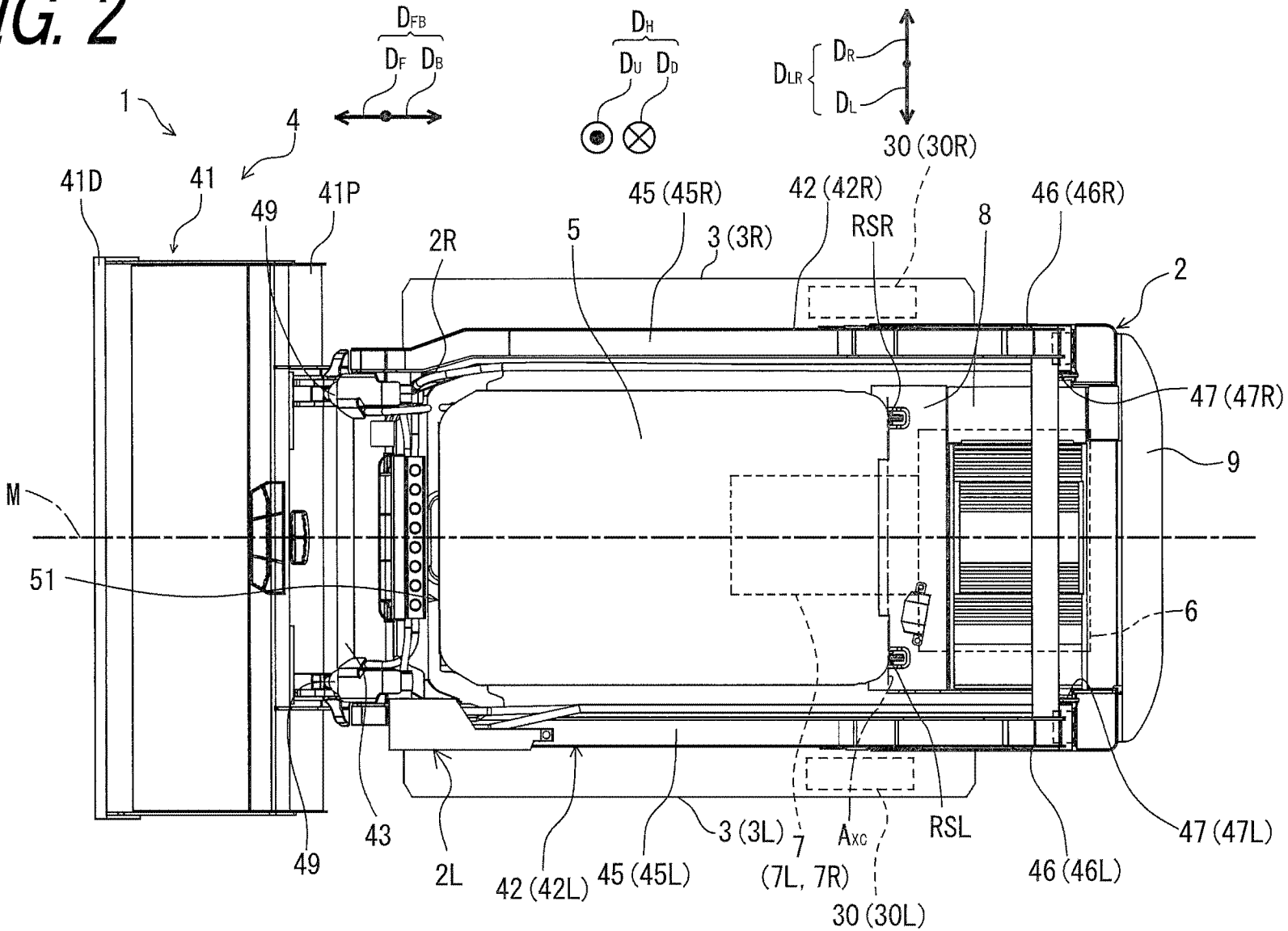
FIG. 2 is a top view of a work machine.

Referring to FIGS. 1 and 2, a work machine 1, for example, a compact truck loader, includes a vehicle body 2, a pair of traveling devices 3, and a working device 4. The vehicle body 2 supports the traveling device 3 and the working device 4. In the illustrated embodiment, the traveling device 3 is a crawler type traveling device. Therefore, each of the pair of traveling devices 3 includes a drive wheel 31 driven by the hydraulic motor device 30, driven wheels 32 and 33, and a rolling wheel 34. However, each of the pair of traveling devices 3 is not limited to a crawler type traveling device. Each of the pair of traveling devices 3 may be, for example, a front wheel/rear wheel traveling device or a traveling device having a front wheel and a rear crawler. The working device 4 includes work equipment (bucket) 41 at the distal end of working device 4. The bucket 41 is a bucket proximal end 41P and a bucket distal end 41D opposite to the bucket proximal end 41P. A proximal end of the working device 4 is attached to a rear portion of the vehicle body 2. The working device 4 includes a pair of arm assemblies 42 for rotatably supporting the bucket 41 via the bucket pivot shaft 43. Each of the pair of arm assemblies 42 includes a link 44 and an arm 45. The arm 45 includes an arm distal end 45D for swingably supporting the bucket proximal end 41P and an arm proximal end 45P opposite to the arm distal end 45D. The arm distal end 45D swingably supports the bucket pivot shaft 43. The vehicle body 2 swingably supports an arm proximal end 45P. Specifically, the vehicle body 2 swingably supports the arm proximal end 45P via the link 44.

The link 44 is rotatable with respect to the vehicle body 2 around a fulcrum shaft 46. The arm 45 is rotatable with respect to the link 44 around the joint shaft 47. The working device 4 further includes a plurality of arm cylinders 48 and at least one bucket cylinder 49. Each of the plurality of arm cylinders 48 is rotatably connected to the vehicle body 2 and the arm 45, and moves the link 44, the arm 45 and the like to move the bucket 41 up and down. At least one bucket cylinder 49 is configured to tilt the bucket 41. A vehicle body 2 includes a cabin 5. A cabin 5 is provided with a front window 51 which can be opened and closed freely, and an outer shape thereof is defined by a cab frame 53. The front window 51 may be omitted. A work machine 1 includes a driver's seat 54 and an operating lever 55 in a cabin 5. As shown in FIG. 2, the cab frame 53 is rotatable about rotational shafts RSL and RSR on the vehicle body 2. FIGS. 1 and 2 illustrate a common pivot axis AXC which is defined by the rotational axes RSL and RSR. That is, the cab frame 53 is attached to the vehicle body 2 so as to be rotatable about the pivot axis AXC.

In the embodiment according to the present application, the front-back direction $D_{FB}$ (Forward $D_F$/backward$_{DB}$) means a forward and backward direction (forward/backward direction) as seen from an operator sitting on the driver's seat 54 of the cabin 5. Left direction DL, right direction $D_R$, width direction $D_W$ mean a left direction, a right direction, and a left/right direction, respectively, when viewed from the operator. Up direction $D_U$, down direction $D_D$; height DH mean an upward direction, a downward direction and a height direction as viewed from the operator. The front/back, left/right (width), and up/down (height) directions of the work machine 1 correspond to the front/back, left/right (width), and up/down (height) directions as viewed from the operator.

FIG. 1 shows the left side of the work machine 1. As shown in FIG. 2, the vehicle body 2 is substantially symmetrical with respect to a center plane M of the vehicle body, and has a first side surface 2L which is a left side surface and a second side surface 2R which is a right side surface. Among the pair of traveling devices 3, the traveling device 3 provided on the first side surface 2L is shown as the first traveling device 3L, and the traveling device 3 provided on the second side surface 2R is shown as the second traveling device 3R. Among the pair of arm assemblies 42, the arm assembly 42 provided on the left side with respect to the center plane M of the vehicle body is shown as a first arm assembly 42L, and an arm assembly 42 provided on the right side with respect to the vehicle body center plane M is shown as a second arm assembly 42R. A link 44 provided on the left side with respect to the center plane M of the vehicle body is shown as a first link 44L. An arm 45 provided on the left side with respect to the vehicle body center plane M is shown as a first arm 45L, and an arm 45 provided on the right side with respect to the vehicle body center plane M is shown as a second arm 45R. The fulcrum shaft 46 located on the left side of the vehicle body center plane Mi shown as a first fulcrum shaft 46L, a fulcrum shaft 46 provided on the right side of the vehicle body center plane M is shown as the second fulcrum shaft 46R. A joint shaft 47 provided on the left side with respect to the vehicle body center plane M is shown as a first joint shaft 47L, and a joint shaft 47 provided on the right side with respect to the vehicle body center plane M is shown as a second joint shaft 47R. Among the hydraulic motor devices 30, the hydraulic motor device 30 provided on the left side with respect to the vehicle body center plane M is shown as a first hydraulic motor device 30L, the hydraulic motor device 30 provided on the right side with respect to the vehicle body center plane M is shown as a second hydraulic motor device 30R.

Referring to FIGS. 1 and 2, the work machine 1 includes an engine 6 provided at a rear portion of a vehicle body 2, and a plurality of hydraulic pumps 7 including the first traveling hydraulic pump 7L, and a second traveling hydraulic pump 7R. The engine 6 drives a plurality of hydraulic pumps 7. The first hydraulic pump 7L and the second hydraulic pump 7R are configured to discharge hydraulic fluid to drive a hydraulic motor device 30 for driving a drive wheel 31. The plurality of hydraulic pumps 7 other than the first hydraulic pump 7L and the second hydraulic pump 7R are configured to discharge hydraulic fluid to drive hydraulic actuators (a plurality of arm cylinders 48, at least one bucket cylinder 49, and the like) connected to the working device 4. The engine 6 is provided between a pair of arm assemblies 42 in the width direction $D_W$ of the work machine 1. The work machine 1 further includes a cover 8 for covering the engine 6. The work machine 1 further includes a bonnet cover 9 provided at the rear end of the vehicle body 2. As the bonnet cover 9 is openable, a maintenance worker can perform maintenance work on the engine 6 and the like.

<Hydraulic System>

Figure 3:
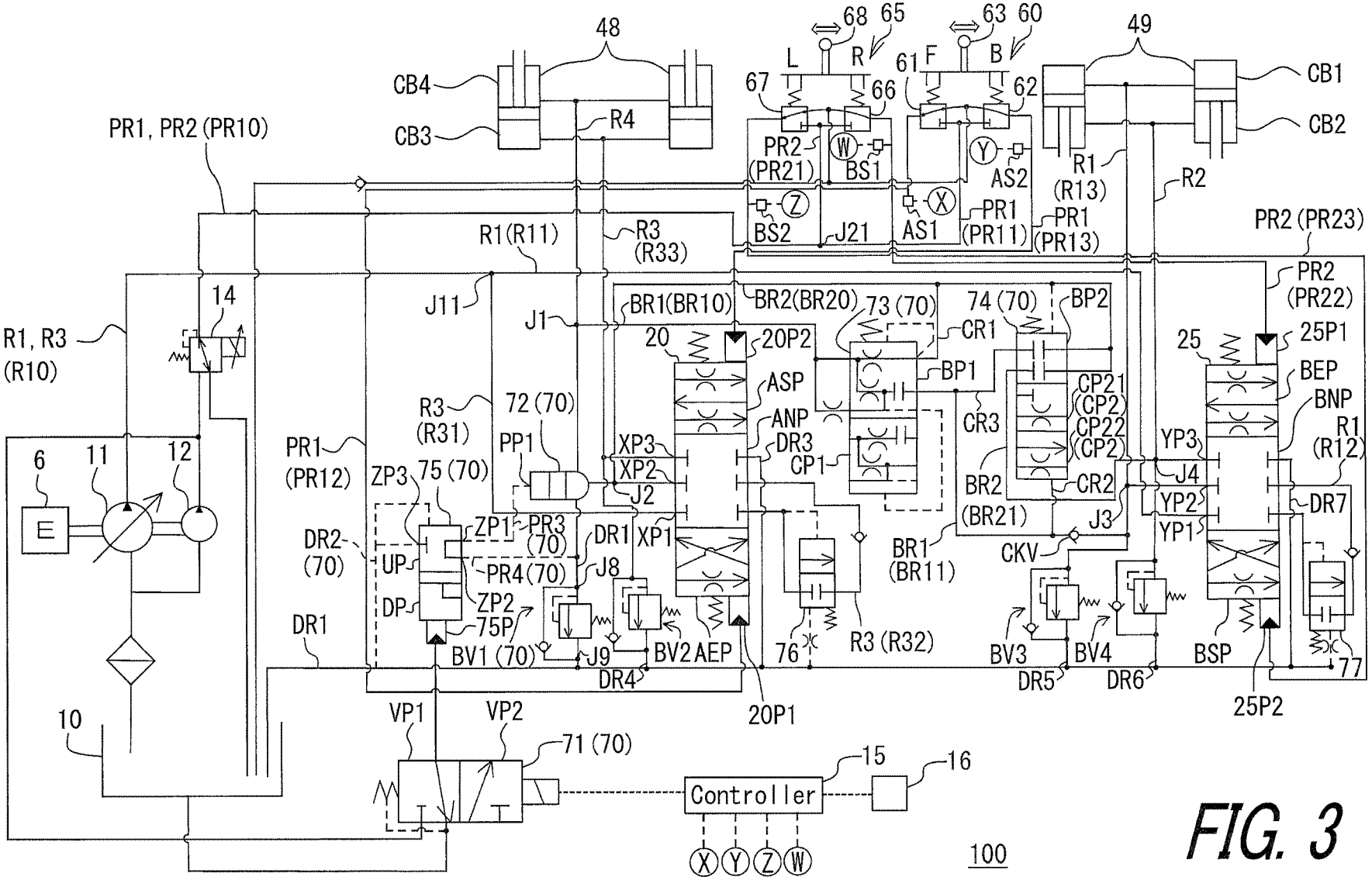
FIG. 3 is a schematic configuration diagram of a hydraulic system of the work machine.

A work machine 1 is provided with a hydraulic system 100. FIG. 3 is a schematic configuration diagram of the hydraulic system 100 of the work machine 1. A hydraulic system 100 includes an arm cylinder 48, a bucket cylinder 49, a first hydraulic pump 11, a second hydraulic pump 12, an arm control valve 20, a bucket control valve 25, an arm pilot control valve 60, a bucket pilot control valve 65, a first oil passage R1, a second oil passage R2, a third oil passage R3, a fourth oil passage R4, a first pilot oil passage PR1, and a second pilot oil passage PR2, a bypass oil passage BR1, a switching mechanism 70, and an arm operation detection sensors AS1 and AS2, a bucket operation detection sensor BS1, BS2, and a controller 15.

The bucket cylinder 49 includes a first chamber CB1 into which the hydraulic fluid flows when the bucket distal end 41D is tilted downward and a second chamber CB2 into which the hydraulic fluid flows when the bucket distal end 41D is tilted upward. The arm cylinder 48 includes a third chamber CB3 into which the hydraulic fluid flows when the arm distal end 45D is raised and a fourth chamber CB4 into which the hydraulic fluid flows when the arm distal end 45D is lowered. The first hydraulic pump 11 is driven by the engine 6 and is configured to discharge the hydraulic fluid stored in the hydraulic fluid tank 10 to the bucket cylinder 49 and the arm cylinder 48. The first hydraulic pump 11 is, for example, a variable displacement type hydraulic pump. The second hydraulic pump 12 is driven by the engine 6 and is configured to discharge pilot oil for controlling the arm control valve 20 and the bucket control valve 25. Among the hydraulic fluid stored in the hydraulic fluid tank 10, the hydraulic fluid discharged from the second hydraulic pump 12 and used for control may be referred to as pilot fluid, and the pressure of the pilot fluid may be referred to as pilot pressure. The second hydraulic pump 12 is, for example, a constant capacity type hydraulic pump.

First oil passage R1 connects the first hydraulic pump 11 and the first chamber CB1 of the bucket cylinder 49. The bucket control valve 25 is provided in the first oil passage R1, and includes bucket control pilot ports 25P1 and 25P2 and is configured to control the hydraulic fluid supplied to the first chamber CB1 and the second chamber CB2 of the bucket cylinder 49 according to the hydraulic pressure of pilot oil applied to pilot ports 25P1 and 25P2. The bucket control valve 25 switches to the bucket cylinder static control position BNP, the bucket cylinder extension control position BEP, or the bucket cylinder contraction control position BSP according to the pressure difference between the pilot pressure applied to the bucket control pilot port 25P1 and the pilot pressure applied to the bucket control pilot port 25P2. The first oil passage R1 includes a partial oil passage R10 common with a third oil passage R3 extending from the first hydraulic pump 11 to the joint J11, and a partial oil passage R11 extending from the joint J11 to the bucket control valve 25, a partial oil passage R12 connecting different connection ports of the bucket control valve 25, and a partial oil passage R13 extending from the bucket control valve 25 to the first chamber CB1 of the bucket cylinder 49. The second oil passage R2 connects the bucket control valve 25 and the second chamber CB2 of the bucket cylinder 49. The first oil passage R1 and the second oil passage R2 are branched by being connected to different ports of the bucket control valve 25.

More specifically, the bucket control valve 25 includes a first bucket control valve port YP1, a second bucket control valve 25 port YP2, and a third bucket control valve port YP3. The first bucket control valve port YP1 is connected to the first hydraulic pump 11 via a first oil passage R1. The second bucket control valve port YP2 is connected to the first chamber CB1 of the bucket cylinder 49 through the first oil passage R1. The third bucket control valve port YP3 is connected to the second oil passage R2. When the pilot pressure applied to the bucket control pilot port 25P1 is greater than a predetermined pressure than the pilot pressure applied to the bucket control pilot port 25P2, the bucket control valve 25 is switched to a bucket cylinder extension control position BEP at which the first bucket control valve port YP1 communicates with the second bucket control valve port YP2 and the third bucket control valve port YP3 communicates with a first drain oil passage DR1 (described later). When the pilot pressure applied to the bucket control pilot port 25P2 is larger than the pilot pressure applied to the bucket control pilot port 25P1 than the predetermined pressure, the bucket control valve 25 communicates the first bucket control valve port YP1 with the third bucket control valve port YP3 and switches to the bucket cylinder contraction control position BSP at which the second bucket control valve port YP2 communicates with DR1 (to be described later). When the absolute value of the difference between the pilot pressure applied to the bucket control pilot port 25P2 and the pilot pressure applied to the bucket control pilot port 25P1 is equal to or less than the predetermined pressure, the bucket control valve 25 is switched to a bucket cylinder static control position BNP at which the first bucket control valve 25 port YP1, the second bucket control valve port YP2, and the third bucket control valve 25 port YP3 are isolated. The hydraulic system 100 further includes a second pressure control valve 77 that communicates the first bucket control valve port YP1 with the second bucket control valve port YP2 or the third bucket control valve port YP3 only when the pressure applied to the first bucket control valve port YP1 is equal to or greater than the fourth threshold pressure. As a result, if the hydraulic pressure from the first hydraulic pump 11 does not reach the fourth threshold pressure, the bucket control can be prevented from being performed.

The third oil passage R3 connects the first hydraulic pump 11 and the third chamber CB3 of the arm cylinder 48. The third oil passage R3 includes partial oil passage R10 common to the first oil passage R1 extending from the first hydraulic pump 11 to the joint J11 and a partial oil passage R31 branched from the first oil passage R1 at the joint J11. The arm control valve 20 is provided in the third oil passage R3 and includes an arm control pilot port 20P1, 20P2 and is configured to control the hydraulic fluid supplied to the third chamber CB3 and the fourth chamber CB4 of the arm cylinder 48 according to the hydraulic pressure of the pilot oil applied to the arm control pilot ports 20P1 and 20P2. The arm control valve 20 is configured to switch to the arm cylinder static control position ANP, the arm cylinder extension control position AEP, or the arm cylinder contraction control position ASP by the pressure difference between the pilot pressure applied to the arm control pilot port 20P1 and the pilot pressure applied to the arm control pilot port 20P2. The third oil passage R3 further includes a partial oil passage R32 connecting different connection ports of the arm control valve 20 to each other and a partial oil passage R33 extending to the third chamber CB3 of the arm cylinder 48. The fourth oil passage R4 connects the arm control valve 20 and the fourth chamber CB4 of the arm cylinder 48. The third oil passage R3 and the fourth oil passage R4 are branched by being connected to different ports of the bucket control valve 25.

More specifically, the arm control valve 20 further includes a first arm control valve port XP1, a second arm control valve 20 port XP2, and a third arm control valve 20 port XP3. The first arm control valve 20 port XP1 is connected to the first hydraulic pump 11 via a third oil passage R3. The second arm control valve 20 port XP2 is connected to the fourth oil passage R4. The third arm control valve 20 port XP3 is connected to the third chamber CB3 of the arm cylinder 48 through the third oil passage R3. When the pilot pressure applied to the arm control pilot port 20P1 is larger than the pilot pressure applied to the arm control pilot port 20P2 than the predetermined pressure, the arm control valve 20 is switched to an arm cylinder extension control position AEP at which the first arm control valve port XP1 communicates with the third arm control valve port XP3 and the second arm control valve port XP2 communicates with the first drain oil passage DR1 (to be described later). When the pilot pressure applied to the arm control pilot port 20P2 is larger than the pilot pressure applied to the arm control pilot port 20P1 than the predetermined pressure. the arm control valve 20 is switched to an arm cylinder contraction control position ASP at which the first arm control valve port XP1 communicates with the second arm control valve port XP2 and the third arm control valve port XP3 communicates with the first drain oil passage DR1. When the absolute value of the difference between the pilot pressure applied to the arm control pilot port 20P2 and the pilot pressure applied to the arm control pilot port 20P1 is equal to or less than the predetermined pressure, the arm control valve 20 is switched to the arm cylinder static control position ANP at which the first arm control valve port XP1, the second arm control valve port XP2 and the third arm control valve port XP3 are isolated. In addition, the hydraulic system 100 includes a first pressure control valve 76 to connect the first arm control valve port XP1 to the second arm control valve port XP2 or the third arm control valve port XP3 only when the pressure applied to the first arm control valve port XP1 is not less than a third threshold pressure. As a result, if the hydraulic pressure from the first hydraulic pump 11 does not reach the third threshold pressure, the arm control can be prevented from being performed.

First pilot oil passage PR1 connects the arm control pilot ports 20P1 with the second hydraulic pump 12. Specifically, the first pilot oil passage PR1 includes a partial oil passage PR10 common to the second pilot oil passage PR2 extending from the second hydraulic pump 12 to the joint J21, a partial oil passage PR11 extending from the joint J21 to the arm pilot control valve 60, a partial oil passage PR12 extending from the arm pilot control valve 60 to the arm control pilot port 20P1, and a partial oil passage PR13 extending from the arm pilot control valve 60 to the arm control pilot port 20P2. The hydraulic system 100 further includes an additional electromagnetic valve 14 provided in the partial oil passage PR10. That is, the additional electromagnetic valve 14 is provided in at least one of the first pilot oil passage PR1 between the second hydraulic pump 12 and the arm pilot control valve 60 and the second pilot oil passage PR2 between the second hydraulic pump 12 and the bucket pilot control valve 65. The additional electromagnetic valve 14 is an electromagnetic valve capable of changing the pressure of the hydraulic fluid output from the second hydraulic pump 12. The pressure of the hydraulic fluid can be changed by control from the controller 15.

The arm pilot control valve 60 controls the hydraulic pressure of the pilot oil applied to the arm control pilot ports 20P1 and 20P2 based on an operation amount of an arm input member 63 which is provided in the first pilot oil passage PR1 and is operated to raise and lower the arm 45. Specifically, the arm pilot control valve 60 includes a pressure control valve 61 connected to the partial oil passage PR12 and a pressure control valve 62 connected to the partial oil passage PR12. When the arm input member 63 is tilted forward, the pressure control valve 61 is operated so that the pilot pressure is output from the pressure control valve 61 to the partial oil passage PR12. This pilot pressure acts on the arm control pilot port 20P1 of the arm control valve 20. When the arm input member 63 is tilted rearward, the pressure control valve 62 is operated so that pilot pressure is output from the pressure control valve 62 to the partial oil passage PR13. This pilot pressure acts on the arm control pilot port 20P2 of the arm control valve 20.

More specifically, when the arm input member 63 is operated to move the arm 45 upward (i. e., the arm input member 63 is moved backward), the pilot pressure applied to the arm control pilot port 20P1 becomes larger than the pilot pressure applied to the arm control pilot port 20P2 than the predetermined pressure. When the arm input member 63 is operated to lower the arm 45 (operation to lower the arm input member 63 to the front side), the pilot pressure applied to the arm control pilot port 20P2 becomes larger than the pilot pressure applied to the arm control pilot port 20P1 than the predetermined pressure. When the operation amount of the arm input member 63 is smaller than the predetermined threshold amount, the absolute value of the difference between the pilot pressure applied to the arm control pilot port 20P2 and the pilot pressure applied to the arm control pilot port 20P1 is equal to or smaller than the predetermined pressure. The arm operation detection sensors AS1 and AS2 are configured to detect the arm input member 63. The arm operation detection sensor AS1 is, for example, a pressure switch connected to the partial oil passage PR12. The arm operation detection sensor AS1 outputs a predetermined electric signal to the controller 15 when the pilot pressure of the partial oil passage PR12 exceeds a predetermined pressure. The arm operation detection sensor AS2 outputs a predetermined electric signal to the controller 15 when the pilot pressure of the partial oil passage PR13 exceeds a predetermined pressure.

The second pilot oil passage PR2 connects the bucket control pilot ports 25P1 and 25P2 to the second hydraulic pump 12. Specifically, the second pilot oil passage PR2 includes a partial oil passage PR10 common to the first pilot oil passage PR1 extending from the second hydraulic pump 12 to the joint J21, a partial oil passage PR21 extending from the joint J21 to the bucket pilot control valve 65, a partial oil passage PR22 extending from the bucket pilot control valve 65 to the bucket control pilot port 25P1, and a partial oil passage PR23 extending from the bucket pilot control valve 65 to the bucket control pilot port 25P2. The bucket pilot control valve 65 is provided in the second pilot oil passage PR2, and controls the hydraulic pressure of the pilot oil applied to the bucket control pilot ports 25P1 and 25P2 based on the operation amount of the bucket input member 68 operated for swinging the bucket 41. Specifically, the bucket pilot control valve 65 includes a pressure control valve 66 connected to the partial oil passage PR22 and a pressure control valve 67 connected to the partial oil passage PR23.

When the bucket input member 68 is tilted to the right, the pressure control valve 66 is operated so that the pilot pressure is output from the pressure control valve 66 to the partial oil passage PR22. This pilot pressure acts on the bucket control pilot port 25P1 of the bucket control valve 25. When the bucket input member 68 is tilted to the left, the pressure control valve 67 is operated to output the pilot pressure to the partial oil passage PR23 from the pressure control valve 67. This pilot pressure acts on the bucket control pilot port 25P2 of the bucket control valve 25.

More specifically, when the bucket input member 68 performs an operation to tilt the bucket distal end 41D downward (an operation to tilt the bucket input member 68 to the right), the pilot pressure applied to the bucket control pilot port 25P1 becomes larger than the pilot pressure applied to the bucket control pilot port 25P2 than the predetermined pressure. When the bucket input member 68 performs an operation to tilt the bucket distal end 41D upward (an operation to tilt the bucket input member 68 to the left), the pilot pressure applied to the bucket control pilot port 25P2 becomes larger than the pilot pressure applied to the bucket control pilot port 25P1 than the predetermined pressure. When the operation amount of the bucket input member 68 is smaller than a predetermined threshold amount, the absolute value of the difference between the pilot pressure applied to the bucket control pilot port 25P2 and the pilot pressure applied to the bucket control pilot port 25P1 is equal to or smaller than the predetermined pressure.

Although the arm input member 63 and the bucket input member 68 are shown as separate members in FIG. 3, they may be the same members. In this case, the pressure control valves 61, 62, 66 and 67 are arranged around the same member. The bucket operation detection sensor BS1 outputs a predetermined electric signal to the controller 15 when the pilot pressure of the partial oil passage PR22 exceeds a predetermined pressure. The bucket operation detection sensor BS2 outputs a predetermined electric signal to the controller 15 when the pilot pressure of the partial oil passage PR23 exceeds a predetermined pressure.

The bypass oil passage BR1 connects the fourth oil passage R4 and the first oil passage R1. The bypass oil passage BR1 is connected to the fourth oil passage R4 at the first joint J1. The bypass oil passage BR1 is connected to the first oil passage R1 at a third joint J3. The switching mechanism 70 is configured to control connection of the fourth oil passage R4 to the first oil passage R1 via the bypass oil passage BR1 and disconnection of the fourth oil passage R4 from the first oil passage R1 via the bypass oil passage BR1. A controller 15 is configured to determine whether or not an uptilt operation to raise an arm 45 and to tilt a bucket 41 downward has been performed based on the outputs of arm operation detection sensors AS1, AS2 and the outputs of bucket operation detection sensors BS1, BS2, and to control a switching mechanism 70 so as to connect a fourth oil passage R4 and a first oil passage R1 when it is determined that the uptilt operation has been performed. The controller 15 is, for example, a hardware controller such as an ECU. Therefore, the controller 15 includes an electronic circuit (circuitry) such as a hardware processor and a memory.

The switching mechanism 70 includes the electromagnetic valve 71 and the first switching valve 72. The first switching valve 72 is provided in the fourth oil passage R4 between the first joint J1 and the arm control valve 20, and includes a first pilot port PP1. The first switching valve 72 is configured so as to cut off the connection of the arm control valve 20 to the fourth chamber CB4 of the arm cylinder 48 via the fourth oil passage R4 when a pilot oil pressure equal to or greater than a first threshold pressure is applied to the first pilot port PP1, and to connect the arm control valve 20 and the fourth chamber CB4 via the fourth oil passage R4 when a pilot oil pressure smaller than the first threshold pressure is applied to the first pilot port PP1. The electromagnetic valve 71 is switchable between a second position VP2 at which the first pilot port PP1 communicates with the hydraulic fluid tank 10 and a first position VP1 at which the first pilot port PP1 communicates with an oil passage capable of applying a pilot pressure equal to or greater than a first threshold pressure to the first pilot port PP1.

A controller 15 is connected to a solenoid of the electromagnetic valve 71. For example, when the pilot pressure of a partial oil passage PR12 obtained from an arm operation detection sensor AS1 is larger than the pilot pressure of a partial oil passage PR13 obtained from an arm operation detection sensor AS1 than a first threshold pressure and the pilot pressure of a partial oil passage PR22 obtained from a bucket operation detection sensor BS1 is larger than the pilot pressure of a partial oil passage PR23 obtained from a bucket operation detection sensor BS2, the controller 15 determines that the uptilt operation has been performed and transmits to the electromagnetic valve 71 an electric signal for switching the electromagnetic valve 71 to a first position VP1.

Further, the work machine further includes an ON/OFF switch 16 connected to the controller 15. The switch 16 is turned ON, and then, the controller 15 transmits an electric signal for switching the electromagnetic valve 71 to the first position VP1 to the electromagnetic valve 71. The switch 16 is turned ON when horizontal control is performed in which the tilt angle of the bucket distal end 41D is changed corresponding to the elevation angle of the arm 45 with respect to the vehicle body 2 so that the direction from the bucket pivot shaft 43 toward the bucket distal end 41D is maintained substantially parallel to the horizontal plane.

The work machine 1 further includes an additional bypass oil passage BR2 which connects a fourth oil passage R4 between the first switching valve 72 and the arm control valve 20 and the second oil passage R2. The additional bypass oil passage BR2 is connected to the fourth oil passage R4 at the second joint J2 and is connected to the second oil passage R2 at the fourth joint J4. The switching mechanism 70 further includes a second switching valve 73 provided in the bypass oil passage BR1 and a third switching valve 74 provided in the additional bypass oil passage BR2. The bypass oil passage BR1 includes a partial oil passage BR10 from the first joint J1 through the second switching valve 73, and an oil passage BR11 from the second switching valve 73 through the third joint J3. The additional bypass oil passage BR2 includes a partial oil passage BR20 from the second joint J2 to the third switching valve 74 and a partial oil passage BR21 from the third switching valve 74 to the fourth joint J4. The work machine 1 includes a first connection passage CR1 connecting an additional bypass oil passage BR2 (partial oil passage BR20) between a second joint J2 and a third switching valve 74 with f the second switching valve 73, the second connection passage CR2 connecting a bypass oil passage BR1 (partial oil passage BR11) between a third joint J3 and the second switching valve 73 with a third switching valve 74, and a third connection passage CR3 connecting a bypass oil passage BR1 (partial oil passage BR11) between the second connection passage CR2 and the second switching valve 73 with the second switching valve 73.

The second switching valve 73 is configured to be switched to a first communication position CP1 connected the first joint J1 with the third joint J3 when the first hydraulic pressure of the bypass oil passage BR1 between the first joint J1 and the second switching valve 73 is higher than the second hydraulic pressure of the first connection passage CR1, and to be switched to a first cut-off position BP1 at which communication between the first joint J1 and the third joint J3 is cut off a when the second hydraulic pressure is equal to or lower than the first hydraulic pressure. When the second switching valve 73 is switched to the first cut-off position BP1, the second switching valve 73 is configured to connect the partial oil passage BR10 and the first connection passage CR1. The second switching valve 73 is configured to cut-off the partial oil passage BR10 and the first connection passage CR1 when it is switched to the first communication position CP1.

The third switching valve 74 switches to any one of a second cut-off position BP2, the 21st communication position CP21, or a 22nd communication position CP22, based on a third hydraulic pressure of an additional bypass oil passage BR2 (partial oil passage BR20) between the second joint J2 and the third switching valve 74, and the fourth hydraulic pressure of the second connection passage CR2. The 21st communication position CP21 and the 22nd communication position CP22 are collectively referred to as a second communication position CP2. Since the check valve CKV is provided between the second connection passage CR2 and the third joint J3, the hydraulic pressure in the first oil passage R1 does not affect the hydraulic pressure in the second connection passage CR2. The third switching valve 74 is configured to switch to a second communication position CP2 at which the second joint J2 and the fourth joint J4 communicate with each other when the third hydraulic pressure is lower than the fourth hydraulic pressure, and to switch to a second cut-off position BP2 at which the communication between the second joint J2 and the fourth joint J4 is blocked when the fourth hydraulic pressure is equal to or lower than the third hydraulic pressure. When the difference between the fourth hydraulic pressure and the third hydraulic pressure is smaller than a predetermined pressure, the third switching valve 74 switches to the 21st communication position CP21 to establish communication between the second joint J2 and the fourth joint J4, and cut off the connection of the third connection passage CR3 from the partial oil passage BR11. On the other hand, when the third hydraulic pressure is lower than the fourth hydraulic pressure by a predetermined pressure or more, the third switching valve 74 switches to the 21st communication position CP21 to establish communication between the second joint J2 and the fourth joint J4 and to connect the third connection passage CR3 and the bypass oil passage BR1 (partial oil passage BR11). As a result, the hydraulic pressure in the bypass oil passage BR1 (partial oil passage BR11) can be prevented from becoming too high.

Furthermore, the work machine 1 is further provided with a first drain oil passage DR1 which connects the fourth chamber CB4 of the arm cylinder 48 to the hydraulic fluid tank 10 when the arm control valve 20 is connected to the fourth chamber CB4 of the arm cylinder 48 via the fourth oil passage R4 by the first switching valve 72. The switching mechanism 70 is further provided with a first counter balance valve BV1 provided in the first drain oil passage DR1, a fourth switching valve 75, a third pilot oil passage PR3 connected to the fourth switching valve 75 and the first pilot port PP1 of the first switching valve 72, a fourth pilot oil passage (PR4) connected to the fourth switching valve 75 and the first drain oil passage DR1 between the first switching valve 72 and the first counter balance valve BV1, and a second drain oil passage DR2 connected to the fourth switching valve 75 and the hydraulic fluid tank 10. First counter balance valve BV1 is a pressure control valve configured to be opened when the pressure of the joint J8 shown in the figure becomes higher than that of the joint J9 by a predetermined pressure or more, so that the hydraulic fluid flows from the joint J8 to the joint J9. The first threshold pressure is lower than a predetermined pressure at which the first counter balance valve BV1 opens. The similar counter balance valves BV2 to BV4 are connected to fourth to sixth drain oil passages DR4 to DR6 connected to the third oil passage R3, the first oil passage R1, and the second oil passage R2, respectively. The fourth to sixth drain oil passages DR4 to DR6 are connected to the first drain oil passage DR1.

The fourth switching valve 75 includes a first connection port ZP1 connected to the third pilot oil passage PR3, a second connection port ZP2 connected to a fourth pilot oil passage PR4, a third connection port ZP3 connected to a second drain oil passage DR2, and a switching valve pilot port 75P to which pilot pressure is applied by an electromagnetic valve 71. When the pilot oil pressure equal to or higher than the second threshold pressure is applied to the switching valve pilot port 75P, the fourth switching valve 75 is switched to a drain position DP at which the first connection port ZP1, the second connection port ZP2, and the third connection port ZP3 communicate with each other. When a pilot oil pressure smaller than a second threshold pressure is applied to the switching valve pilot port 75P, the fourth switching valve 75 is switched to a pressure increasing position UP where the first connection port ZP1 and the second connection port ZP2 communicate with each other and the third connection port ZP3 is disconnected from the first connection port ZP1 and the second connection port ZP2.

When the electromagnetic valve 71 is switched to the second position VP2 by the controller 15, a pilot oil pressure equal to or higher than the second threshold pressure is applied to the switching valve pilot port 75P. Therefore, the fourth switching valve 75 is switched to the drain position DP, and the pilot pressure applied to the first pilot port PP1 becomes lower than the first threshold pressure. At this time, the first switching valve 72 opens to connect the arm control valve 20 with the fourth chamber CB4 via the fourth oil passage R4, and the fourth oil passage R4 is connected to the first drain oil passage DR1 to the first counter balance valve BV1.

At this time, when the arm input member 63 is tilted to the front side, the pilot pressure applied to the arm control pilot port 20P1 becomes larger than the pilot pressure applied to the arm control pilot port 20P2 than the predetermined pressure, so that the arm control valve 20 is switched to the arm cylinder extension control position AEP. Therefore, the hydraulic fluid having a pressure exceeding the third threshold pressure from the first hydraulic pump 11 is sent to the third chamber CB3 of the arm cylinder 48 via the arm control valve 20. As a result, the hydraulic fluid is output from the fourth chamber CB4 of the arm cylinder 48 to the fourth oil passage R4. Since the first switching valve 72 is opened, the hydraulic fluid is sent to the second arm control valve port XP2 of the arm control valve 20 and is discharged to the third drain oil passage DR3 connected to the first drain oil passage DR1.

Further, when the arm input member 63 is tilted backward, the pilot pressure applied to the arm control pilot port 20P2 becomes larger than the pilot pressure applied to the arm control pilot port 20P1 than the predetermined pressure, so that the arm control valve 20 is switched to the arm cylinder contraction control position ASP. Therefore, the hydraulic fluid having a pressure exceeding the third threshold pressure from the first hydraulic pump 11 is sent to the fourth chamber CB4 of the arm cylinder 48 via the arm control valve 20 and the first switching valve 72. As a result, the hydraulic fluid is output from the third chamber CB3 of the arm cylinder 48 to the third oil passage R3. The hydraulic fluid is sent to the third arm control valve 20 port XP3 of the arm control valve 20 and is discharged to a third drain oil passage DR3 connected to the first drain oil passage DR1.

When the electromagnetic valve 71 is switched to the second position VP2 by the controller 15, the control of the bucket 41 is performed independently of the control of the arm 45 except for the uptilt operation. In this state, when the bucket input member 68 is tilted to the right, the pilot pressure applied to the bucket control pilot port 25P1 becomes larger than the pilot pressure applied to the bucket control pilot port 25P2 than the predetermined pressure, so that the bucket control valve 25 is switched to the bucket cylinder extension control position BEP. Therefore, the hydraulic fluid having a pressure exceeding the fourth threshold pressure from the first hydraulic pump 11 is sent to the first chamber CB1 of the bucket cylinder 49 via the bucket control valve 25. As a result, the hydraulic fluid is output from the second chamber CB2 of the bucket cylinder 49 to the second oil passage R2. The hydraulic fluid is sent to the third bucket control valve port YP3 of the bucket control valve 25 and is discharged to the seventh drain oil passage DR7 connected to the first drain oil passage DR1.

When the bucket input member 68 is tilted to the left, the pilot pressure applied to the bucket control pilot port 25P2 becomes larger than the pilot pressure applied to the bucket control pilot port 25P1 than the predetermined pressure, so that the bucket control valve 25 is switched to the bucket cylinder contraction control position BSP. Therefore, the hydraulic fluid having a pressure exceeding the fourth threshold pressure from the first hydraulic pump 11 is sent to the second chamber CB2 of the bucket cylinder 49 via the bucket control valve 25. As a result, the hydraulic fluid is output from the first chamber CB1 of the bucket cylinder 49 to the first oil passage R1. The hydraulic fluid is sent to the second bucket control valve port YP2 of the bucket control valve 25 and is discharged to the seventh drain oil passage DR7 connected to the first drain oil passage DR1.

When the electromagnetic valve 71 is switched to the first position VP1 by the controller 15 after the electromagnetic valve 71 is switched to the second position VP2 by the controller 15, a pilot oil pressure smaller than the second threshold pressure is applied to the switching valve pilot port 75P, and the fourth switching valve 75 is switched to the pressure increasing position UP. Although the pilot pressure applied to the first pilot port PP1 is lower than the first threshold pressure at the beginning of the switching, the pilot pressure rises immediately due to the pressure of the hydraulic fluid flowing from the fourth oil passage R4. Since the predetermined pressure at which the first counter balance valve opens is higher than the first threshold pressure, the pilot pressure exceeds the first threshold pressure, and the first switching valve 72 is closed. Therefore, the connection of the arm control valve 20 to the fourth chamber CB4 of the arm cylinder 48 via the fourth oil passage R4 is cut off.

When the first switching valve 72 is closed, the arm control valve 20 is switched to the arm cylinder extension control position AEP, and the bucket control valve 25 is switched to the bucket cylinder static control position BNP when the arm 45 is being operated to raise (the arm input member 63 is tilted to the rear side) and the bucket 41 is not being operated at all (the bucket input member 68 is not tilted to any place). When the arm input member 63 and the bucket input member 68 are the same as each other, the same input member is moved backward without moving left and right.

At this time, as described above, the hydraulic fluid flows out from the fourth chamber CB4 of the arm cylinder 48, but flows from the first joint J1 to the second switching valve 73 because the first switching valve 72 is closed. Further, since the additional bypass oil passage BR2 and the first connection passage CR1 connected thereto are connected to the third drain oil passage DR3, the first hydraulic pressure of the bypass oil passage BR1 (partial oil passage BR10) between the first joint J1 and the second switching valve 73 is greater than the second hydraulic pressure.

As a result, the second switching valve 73 is switched to the first communication position CP1. At this time, the hydraulic fluid is sent from the second switching valve 73 to the first chamber CB1 of the bucket cylinder 49 via the bypass oil passage BR1 (partial oil passage BR11) and the first oil passage R1 (partial oil passage R13). At this time, the hydraulic fluid is output from the second chamber CB2 of the bucket cylinder 49 to the second oil passage R2 and the additional bypass oil passage BR2 (partial oil passage BR21). Since the third switching valve 74 is located at the second cut-off position BP2, the hydraulic fluid cannot flow and the hydraulic pressure in the second connection passage CR2 rises. When the difference between the fourth hydraulic pressure in the second connection passage CR2 and the third hydraulic pressure in the additional bypass oil passage BR2 (partial oil passage BR20) exceeds the connection threshold pressure, switching to either the 21st communication position CP21 or the 22nd communication position CP22 is performed based on the difference between the third hydraulic pressure in the additional bypass oil passage BR2 (partial oil passage BR20) and the fourth hydraulic pressure in the second connection passage CR2. When the difference between the fourth hydraulic pressure and the third hydraulic pressure is smaller than a predetermined switching threshold value, the third switching valve 74 is switched to the 21st communication position CP21. When the difference between the fourth hydraulic pressure and the third hydraulic pressure is equal to or greater than a predetermined switching threshold value, the third switching valve 74 is switched to the 22nd communication position CP22. When the third switching valve 74 is switched to the 21st communication position CP21 or the 22nd communication position CP22, the hydraulic fluid output from the second chamber CB2 of the bucket cylinder 49 is discharged to the hydraulic fluid tank 10 via the additional bypass oil passage BR2 and the third drain oil passage DR3.

However, when the hydraulic fluid is discharged from the fourth chamber CB4 of the arm cylinder 48, the second hydraulic pressure of the first connection passage CR1 rise, and the second switching valve 73 is switched to the first cut-off position BP1, the hydraulic fluid flowing out from the fourth chamber CB4 is discharged to the hydraulic fluid tank 10 via the first connection passage CR1, the additional bypass oil passage BR2, and the third drain oil passage DR3. Therefore a portion of the oil discharged from the fourth chamber CB4 of the arm cylinder 48 flows into the first chamber CB1 of the bucket cylinder 49 by flowing to the third chamber CB3 of the arm cylinder 48, and the remainder is discharged into the hydraulic fluid tank 10. The amount discharged into the hydraulic fluid tank 10 is adjusted by empirically adjusting the size of the throttle of the first cut-off position BP1 of the second switching valve 73 so that the change in the elevation angle of the arm 45 with respect to the vehicle body 2 per unit amount of the hydraulic fluid is substantially equal to the change in the swing angle with respect to the arm 45. Therefore, the swing angle of the bucket distal end 41D with respect to the arm 45 is changed in accordance with the elevation angle of the arm to control so that the direction from the bucket pivot shaft 43 toward the bucket distal end is directed generally in the horizontal direction. Such control is referred to as horizontal control.

When the first switching valve 72 is closed, the arm control valve 20 is switched to the arm cylinder contraction control position ASP and the bucket control valve 25 is switched to the bucket cylinder static control position BNP when the arm 45 is being lowered (the arm input member 63 is being tilted forward) and the bucket 41 is not being operated (the bucket input member 68 is not being tilted anywhere). At this time, the hydraulic fluid having a pressure exceeding the third threshold pressure from the first hydraulic pump 11 is output from the second arm control valve 20 port XP2. Since the third threshold pressure is larger than the first threshold pressure and the threshold pressure for opening the first counter balance valve BV1, the hydraulic fluid is sent to the fourth chamber CB4 of the arm cylinder 48 through the fourth oil passage R4 when the first switching valve 72 is pushed to open. At this time, the hydraulic fluid is discharged from the third chamber CB3 of the arm cylinder 48 to the hydraulic fluid tank 10 through the third oil passage R3 and the third drain oil passage DR3.

When the electromagnetic valve 71 is switched to the first position VP1 by the controller 15, the control of the bucket 41 is performed independently of the control of the arm 45 except for the uptilt operation. These methods have been described above and will be omitted. Next, the uptilt operation will be described. In the uptilt operation, the arm 45 is raised (the arm input member 63 is lowered to the front side) and the bucket 41 is tilted downward (the bucket input member 68 is lowered to the right side), which is referred to as the uptilt operation. When the arm input member 63 and the bucket input member 68 are the same, the same input member is tilted to the right and front side. This operation can be detected from the outputs of the arm operation detection sensors AS1 and AS2 and the outputs of the bucket operation detection sensors BS1 and BS2.

For example, it can be determined that the uptilt operation has been performed when the pilot pressure of the partial oil passage PR12 detected by the arm operation detection sensor AS1 is larger than a predetermined pressure (the arm operation detection sensor AS1 transmits a predetermined signal), and the pilot pressure of the partial oil passage PR12 detected by the arm operation detection sensor AS2 is smaller than the predetermined pressure (the arm operation detection sensor AS2 does not transmit the predetermined signal), and the pilot pressure of the partial oil passage PR22 detected by the bucket operation detection sensor BS1 is larger than the predetermined pressure (the bucket operation detection sensor BS1 transmits a predetermined signal), and the pilot pressure of the partial oil passage PR13 detected by the bucket operation detection sensor BS2 is smaller than the predetermined pressure (the bucket operation detection sensor BS1 does not transmit the predetermined signal). The controller 15 acquires the outputs of the arm operation detection sensors AS1, AS2 and the outputs of the bucket operation detection sensors BS1, BS2, and determines whether or not the uptilt operation has been performed. When it is determined that the uptilt operation has been performed, the controller 15 transmits to the electromagnetic valve 71 an electric signal for switching the electromagnetic valve 71 to the first position VP1 regardless of the setting of the ON/OFF switch 16.

When the uptilt operation is performed, the arm control valve 20 is switched to the arm cylinder extension control position AEP, and the bucket control valve 25 is switched to the bucket cylinder extension control position BEP. At this time, as in the case of the horizontal control, the hydraulic fluid flowing out from the fourth chamber CB4 of the arm cylinder 48 is sent to the first chamber CB1 of the bucket cylinder 49. Further, the hydraulic fluid having a pressure exceeding the fourth threshold pressure from the first hydraulic pump 11 is sent to the first chamber CB1 of the bucket cylinder 49 via the bucket control valve 25. Therefore, the tilt speed of the bucket 41 is increased, and the response of the uptilt operation is improved. The hydraulic fluid output from the second chamber CB2 of the bucket cylinder 49 is discharged to the seventh drain oil passage DR7 as described above.

<Control Method of Work machine 1>

Figure 4:
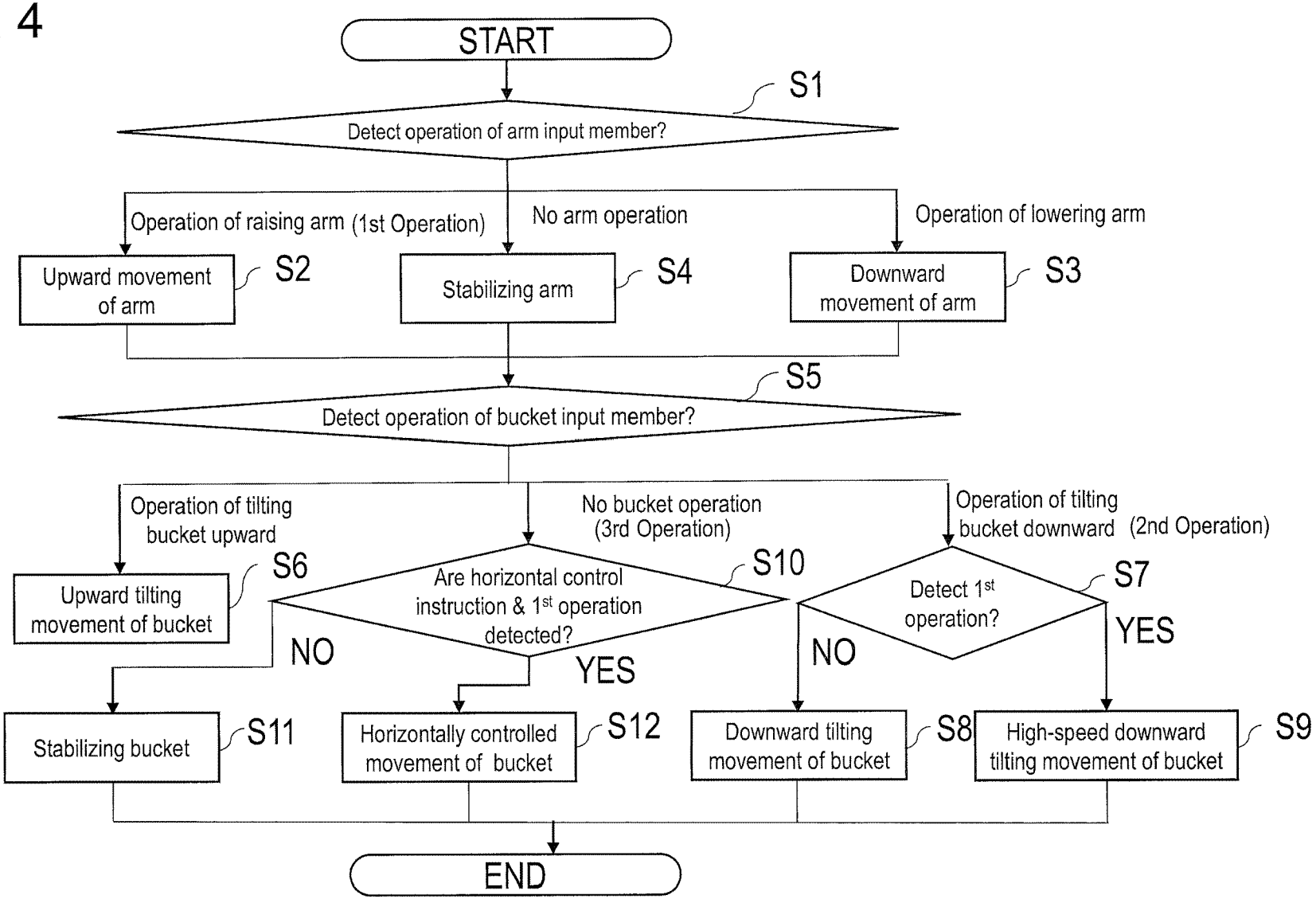
FIG. 4 is a flowchart showing a method of controlling the work machine.

Next, a method of controlling the work machine 1 according to the present embodiment will be described. FIG. 4 is a flowchart showing a method of controlling the work machine 1. In step S1, the controller 15 of the work machine 1 detects the operation of the arm input member 63 which is operated to raise and lower the arm 45. Specifically, based on the outputs from the arm operation detection sensors AS1 and AS2, the controller 15 detects an operation to raise the arm 45 (first operation), an operation of lowering the arm 45, and an operation of bringing the arm 45 to rest. For example, the controller 15 receives a predetermined signal from the arm operation detection sensor AS1 and does not receive the predetermined signal from the arm operation detection sensor AS2, whereby the controller 15 can detect an operation to raise the arm 45. When the controller 15 receives a predetermined signal from the arm operation detection sensor AS2 and does not receive the predetermined signal from the arm operation detection sensor AS1, the controller 15 can detect the operation of lowering the arm 45. When the controller 15 does not receive the predetermined signal from the arm operation detection sensor AS1 and does not receive the predetermined signal from the arm operation detection sensor AS2, the controller 15 can detect the operation of stopping the arm 45.

When the operation to raise the arm 45 is detected in step S1, in step S2, the work machine 1 sends the hydraulic fluid from the first hydraulic pump 11 to the third chamber CB3 of the arm cylinder 48 via the third oil passage R3 to raise (move upward) the arm distal end 45D of the arm 45 which swingably supports the bucket proximal end 41P opposite to the bucket distal end 41D of the bucket 41. When an operation to lower an arm 45 is detected in step S1, in step S3, the work machine 1 uses an arm control valve 20 provided in a third oil passage R3 to establish communication between a third oil passage R3 from a first hydraulic pump 11 to the arm control valve 20 and a fourth oil passage R4 connecting the arm control valve 20 and a fourth chamber CB4 of an arm cylinder 48, send hydraulic fluid from the first hydraulic pump 11 to the fourth chamber CB4 of the arm cylinder 48, and lower (move downward) an arm distal end 45D. When an operation for bringing the arm 45 to a standstill is detected in step S1, in step S4, the work machine 1 switches the arm control valve 20 to the arm cylinder static control position ANP so as to stabilize the arm 45.

In step S5, the controller 15 of the work machine 1 detects the operation of the bucket input member 68 to be operated for swinging the bucket 41. Specifically, based on the outputs from the bucket operation detection sensors BS1 and BS2, the controller 15 detects an operation to tilt the bucket 41 upward and to tilt the bucket 41 downward (second operation) and an operation not to tilt the bucket 41 upward or downward (third operation). For example, when the controller 15 receives a predetermined signal from the bucket operation detection sensor BS2 and does not receive the predetermined signal from the bucket operation detection sensor BS1, the controller 15 detects an operation to tilt the bucket 41 upward. When the controller 15 receives a predetermined signal from the bucket operation detection sensor BS1 and does not receive the predetermined signal from the bucket operation detection sensor BS2, the controller 15 can detect an operation (second operation) to tilt the bucket 41 downward. When the controller 15 does not receive a predetermined signal from the bucket operation detection sensor BS1 and does not receive the predetermined signal from the bucket operation detection sensor BS2, the controller 15 can detect an operation (third operation) in which the bucket 41 is not tilted upward or downward.

When an operation to tilt the bucket 41 upward is detected in step S5, in step S6, the work machine 1 uses the bucket control valve 25 provided in the first oil passage R1 to communicate the first oil passage R1 from the first hydraulic pump 11 to the bucket control valve 25 with the second oil passage R2 that connects the bucket control valve 25 and the second chamber CB2 of the bucket cylinder 49, and sends hydraulic fluid from the first hydraulic pump 11 to the second chamber CB2 of the bucket cylinder 49 to tilt the bucket distal end 41D upward. When an operation (second operation) to tilt the bucket 41 downward is detected in step S5, in step S7, the controller 15 determines whether or not the first operation is detected in step S1. If it is determined that the first operation has not been detected (NO in step S7), in step S8, the work machine 1 sends hydraulic fluid from the first hydraulic pump 11 to the first chamber CB1 of the bucket cylinder 49 via the first oil passage R1 tilt the bucket distal end 41D of the bucket 41 downward. When the first operation and the second operation are detected (YES in step S7), in step S9, the work machine 1 sends the hydraulic fluid to the first chamber CB1 via the first oil passage R1, and connects the fourth oil passage R4 with the first oil passage R1 via the bypass oil passage BR1 by the switching mechanism 70 to send the hydraulic fluid in the fourth oil passage R4 to the first oil passage R1.

If the third operation is detected in step S5, then in step S10, the work machine 1 detects whether or not the ON/OFF switch 16 is set to ON to detect whether or not the horizontal control is instructed. Further, the work machine 1 determines whether or not the first operation is detected in step S1. When the horizontal control instruction is not detected, or the first operation is not detected (No in step S10), in step S11, the work machine 1 switches the bucket control valve 25 to the bucket cylinder static control position BNP so as to stabilize the bucket 41. When the horizontal control is instructed and the first operation and the third operation are detected (YES in step S10), in step S12, the work machine 1 cuts the first oil passage R1 by the bucket control valve 25, connects the fourth oil passage R4 and the first oil passage R1 by the switching mechanism 70, and sends the hydraulic fluid in the fourth chamber CB4 to the first chamber CB1.

Effect of the Embodiment

A controller 15 of a work machine 1 according to this embodiment is configured to determine whether or not the uptilt operation to raise an arm 45 and to tilt a bucket 41 downward has been performed based on the outputs of arm operation detection sensors AS1, AS2 and the outputs of bucket operation detection sensors BS1, BS2, and to control a switching mechanism 70 so as to connect a fourth oil passage R4 and a first oil passage R1 when it is determined that the uptilt operation has been performed. When a first operation to raise an arm 45 and a second operation to tilt a bucket 41 downward are detected, a method for controlling a work machine 1 sends hydraulic fluid to a first chamber CB1 via a first oil passage R1, connects a fourth oil passage R4 and the first oil passage R1 by a switching mechanism 70, and sends hydraulic fluid from the fourth chamber CB4 to the first chamber CB1. As a result, it is possible to provide the work machine 1 and the method of controlling the work machine 1 which can realize the same degree of operability in the uptilt operation regardless of whether the horizontal control is enabled or not.

As used herein, "comprising" and its derivatives are non-limiting terms that describe the presence of a component, and do not exclude the presence of other components not described. This also applies to "having", "including" and their derivatives.

The terms "member," "part," "element," "body," and "structure" may have multiple meanings, such as a single part or multiple parts.

Ordinal numbers such as "first" and "second" are simply terms used to identify configurations and do not have other meanings (e.g., a particular order). For example, the presence of the "first element" does not imply the presence of the "second element", and the presence of the "second element" does not imply the presence of the "first element".

Terms such as "substantially", "about", and "approximately" indicating degrees can mean reasonable deviations such that the final result is not significantly altered, unless otherwise stated in the embodiments. All numerical values described herein may be interpreted to include words such as "substantially," "about," and "approximately."

In the present application, the phrase "at least one of A and B" should be interpreted to include only A, only B, and both A and B.

In view of the above disclosure, it will be apparent that various changes and modifications of the present invention are possible. Therefore, the present invention may be carried out by a method different from the specific disclosure of the present application without departing from the spirit of the present invention.

What is claimed is:

1. The work machine comprising:

a bucket including a bucket proximal end and a bucket distal end opposite to the bucket proximal end;

an arm including an arm distal end that swingably supports the bucket proximal end and an arm proximal end opposite to the arm distal end;

a vehicle body swingably supporting the arm proximal end;

a bucket cylinder comprising:

a first chamber into which hydraulic fluid flows when the bucket distal end is tilted downward; and a second chamber into which hydraulic fluid flows when the bucket distal end is tilted upward;

an arm cylinder comprising:

a third chamber into which hydraulic fluid flows when the arm distal end is raised; and a fourth chamber into which hydraulic fluid flows when the arm distal end is lowered;

a first hydraulic pump configured to discharge hydraulic fluid to the bucket cylinder and the arm cylinder;

a first oil passage connecting the first hydraulic pump and the first chamber of the bucket cylinder;

a bucket control valve provided in the first oil passage and having a bucket control pilot port, the bucket control valve being configured to control hydraulic fluid supplied to the first chamber and the second chamber according to hydraulic pressure of the pilot oil applied to the bucket control pilot port;

a second oil passage connecting the bucket control valve and the second chamber;

a third oil passage connecting the first hydraulic pump and the third chamber of the arm cylinder;

an arm control valve provided in the third oil passage and having an arm control pilot port, the arm control valve being configured to control hydraulic fluid supplied to the third chamber and the fourth chamber according to hydraulic pressure of the pilot oil applied to the arm control pilot port;

a fourth oil passage connecting the arm control valve and the fourth chamber;

a second hydraulic pump configured to discharge pilot oil to control the arm control valve and the bucket control valve;

a first pilot oil passage connecting the arm control pilot port and the second hydraulic pump;

an arm pilot control valve provided in the first pilot oil passage and configured to control the hydraulic pressure of the pilot oil applied to the arm control pilot port based on an operation amount of an arm input member operated to raise and lower the arm;

an arm operation detection sensor configured to detect operation of the arm input member;

a second pilot oil passage connecting the bucket control pilot port and the second hydraulic pump;

a bucket pilot control valve provided in the second pilot oil passage and configured to control the hydraulic pressure of the pilot oil applied to the bucket control pilot port based on an operation amount of a bucket input member operated to swing the bucket;

a bucket operation detection sensor to detect operation of the bucket input member;

a bypass oil passage connecting the fourth oil passage to the first oil passage;

a switching mechanism configured to control connection of the fourth oil passage to the first oil passage via the bypass oil passage and disconnection of the fourth oil passage to the first oil passage via the bypass oil passage; and circuitry configured to:

determine whether an uptilt operation to raise the arm and to tilt the bucket downward has been performed based on an output of the arm operation detection sensor and an output of the bucket operation detection sensor;

control the switching mechanism to connect the fourth oil passage to the first oil passage when it is determined that the uptilt operation has been performed.

2. The work machine according to claim 1, wherein the switching mechanism comprises a first switching valve having a first pilot port and provided in a first part of the fourth oil passage, the first part of the fourth oil passage being provided between the arm control valve and a first joint which connects the bypass oil passage and the fourth oil passage, the first switching valve being configured to disconnect the arm control valve from the fourth chamber via the fourth oil passage when a pilot oil pressure that is equal to or greater than a first threshold pressure is applied to the first pilot, the first switching valve being configured to connect the arm control valve and the fourth chamber via the fourth oil passage when a pilot oil pressure that is smaller than the first threshold pressure is applied to the first pilot port, and an electromagnetic valve which is switchable between a first position and a second position, the first pilot port communicating with the hydraulic fluid tank when the electromagnetic valve is switched to the first position, the first pilot port communicating with an oil passage to apply a pilot pressure that is equal to or greater than a first threshold pressure to the first pilot port when the electromagnetic valve is switched to the second position.

3. The work machine according to claim 2, further comprising:

an additional bypass oil passage connecting the second oil passage and a second part of the fourth oil passage, the second part of the fourth oil passage being provided between the first switching valve and the arm control valve, wherein the switching mechanism further comprises a second switching valve provided in the bypass oil passage, and a third switching valve provided in the additional bypass oil passage, wherein the work machine comprises a first connection passage connecting the second switching valve and a part of the additional bypass oil passage, the first part of the additional bypass oil passage being provided between the third switching valve and a second joint connecting the fourth oil passage and the additional bypass oil passage, and a second connection passage connecting the third switching valve and a first part of the bypass oil passage, the first part of the bypass oil passage being provided between the second switching valve and a third joint connecting the bypass oil passage and the first oil passage, wherein the second switching valve is configured to switch to a first communication position at which the first joint communicates with the third joint when a first hydraulic pressure is greater than a second hydraulic pressure, the first hydraulic pressure being applied to a second part of the bypass oil passage, the second part of the bypass oil passage being provided between the first joint and the second switching valve, the second hydraulic pressure being applied to the first connection passage, and to switch, when the second hydraulic pressure is equal to or lower than the first hydraulic pressure, to a first cut-off position at which the first joint is disconnected from the third joint, and wherein the third switching valve is configured to switch to a second communication position at which the second joint communicates with the fourth joint which connects the second oil passage and the additional bypass oil passage when the third hydraulic pressure of the part of the additional bypass oil passage is smaller than the fourth hydraulic pressure of the second connection passage, and to switch to a second cut-off position at which the second joint is disconnected from the fourth joint when the fourth hydraulic pressure is equal to or lower than the third hydraulic pressure.

4. The work machine according to claim 3, further comprising:

a third connection passage connecting a third part of the bypass oil passage with the third switching valve, the third part of the bypass oil passage being provided between the second connection passage and the second switching valve, wherein the third switching valve connects the third connection passage with the bypass oil passage when a third hydraulic pressure in the part of the additional bypass oil passage is lower than a fourth hydraulic pressure in the second connection passage by a predetermined pressure or more.

5. The work machine according to claim 2, further comprising:

a first drain oil passage to connect the fourth oil passage with the hydraulic fluid tank when the first switching valve connects the arm control valve to the fourth chamber through the fourth oil passage, wherein the switching mechanism comprises a first counter balance valve provided in the first drain oil passage, a fourth switching valve, a third pilot oil passage connected to the fourth switching valve and the first pilot port of the first switching valve, a fourth pilot oil passage connecting the fourth switching valve with a part of the first drain oil passage that is provided between the first switching valve and the first counter balance valve, and a second drain oil passage connecting the fourth switching valve and the hydraulic fluid tank, wherein the fourth switching valve comprises a first connection port connected to the third pilot oil passage, a second connection port connected to the fourth pilot oil passage, a third connection port connected to the second drain oil passage, and a switching valve pilot port to which the pilot pressure is applied via the electromagnetic valve, and wherein, when a pilot oil pressure equal to or greater than a second threshold pressure is applied to the switching valve pilot port, the fourth switching valve is switched to a drain position at which the first connection port, the second connection port, and the third connection port communicates with each other, and when a pilot oil pressure less than the second threshold pressure is applied to the switching valve pilot port, the fourth switching valve is switched to a boost position at which the first connection port and communicates with second connection port and the third connection port is disconnected from the first connection port and the second connection port.

6. The work machine according to claim 5, wherein the arm control valve further comprises a first arm control valve port connected to the first hydraulic pump via the third oil passage, a second arm control valve port connected to the fourth oil passage, a third arm control valve port connected to the third chamber of the arm cylinder via the third oil passage, and the arm control pilot port, wherein, when the arm input member is operated to raise the arm, the arm control valve is switched, according to the pilot pressure applied to the arm control pilot port, to an arm cylinder extension control position at which the first arm control valve port communicates with the third arm control valve port and communicating the second arm control valve port communicates with the first drain oil passage, wherein, when the arm input member is operated to lower the arm, the arm control valve is switched, according to the pilot pressure applied to the arm control pilot port, to an arm cylinder contraction control position at which the first arm control valve port communicates with the second arm control valve port and the third arm control valve port communicates with the first drain oil passage, and wherein, when the operation amount of the arm input member is smaller than a predetermined threshold amount, the arm control valve is switched, according to the pilot pressure applied to the arm control pilot port, to an arm cylinder static control position at which the first arm control valve port, the second arm control valve port, and the third arm control valve port are isolated.

7. The work machine according to claim 6, further comprising:

a first pressure control valve configured to connect the first arm control valve port to the second arm control valve port or the third arm control valve port when the pressure applied to the first arm control valve port is more than or equal to a third threshold pressure.

8. The work machine according to claim 6, wherein the bucket control valve further comprises a first bucket control valve port connected to the first hydraulic pump via the first oil passage, a second bucket control valve port connected to the first chamber of the bucket cylinder via the first oil passage, a third bucket control valve port connected to the second oil passage, and the bucket control pilot port, wherein, when the bucket input member is operated to tilt the bucket distal end downward according to the pilot pressure applied to the bucket control pilot port, the bucket control valve is switched to a bucket cylinder extension control position at which the first bucket control valve port communicates with the second bucket control valve port and the third bucket control valve port communicates with the first drain oil passage, wherein, when the bucket input member is operated to tilt the bucket distal end upward according to the pilot pressure applied to the bucket control pilot port, the bucket control valve is switched to a bucket cylinder contraction control position at which the first bucket control valve port communicates with the third bucket control valve port and the second bucket control valve port communicates with the first drain oil passage, wherein, when the operation amount of the arm input member is smaller than a predetermined threshold amount, the bucket control valve is switched, according to the pilot pressure applied to the bucket control pilot port, to a bucket cylinder static control position at which the first bucket control valve port, the second bucket control valve port, and the third bucket control valve port are isolated.

9. The work machine according to claim 8, further comprising:

a second pressure control valve to connect the first bucket control valve port to the second bucket control valve port or the third bucket control valve port when the pressure applied to the first bucket control valve port is equal to or greater than a fourth threshold pressure.

10. The work machine according to claim 8, further comprising:

a switch electrically connected to the circuitry to turn on and off horizontal control of the bucket, wherein, when the switch is turned on, the circuitry switches the electromagnetic valve to the first position.

11. The work machine according to claim 10, wherein, at the time of the horizontal control, the arm control valve is switched to the arm cylinder extension control position, and the bucket control valve is switched to the bucket cylinder static control position.

12. The work machine according to claim 11, wherein a change in an elevation angle of the arm with respect to the vehicle body per unit amount of hydraulic fluid flowing into the third chamber of the arm cylinder and a swing angle of the bucket distal end with respect to the arm per unit amount of hydraulic fluid flowing into the first chamber of the bucket cylinder are substantially equal to each other.

13. The work machine according to claim 8, wherein, when it is determined that the uptilt operation has been performed, the arm control valve is switched to the arm cylinder extension control position, and the bucket control valve is switched to the bucket cylinder extension control position.

14. The work machine according to claim 1, further comprising:

an additional electromagnetic valve provided on at least one of the first pilot oil passage and the second pilot oil passage to change a pressure of hydraulic fluid outputted from the second hydraulic pump.

15. A control method for a work machine, comprising:

sending hydraulic fluid from a first hydraulic pump to a first chamber of a bucket cylinder via a first oil passage to tilt a bucket distal end of a bucket downward;

controlling a bucket control valve provided in the first oil passage to connect a part of the first oil passage from the first hydraulic pump to a bucket control valve with a second oil passage connecting the bucket control valve and a second chamber of the bucket cylinder to send the hydraulic fluid from the first hydraulic pump to the second chamber of the bucket cylinder to tilt the bucket distal end upward;

sending the hydraulic fluid from the first hydraulic pump to a third chamber of an arm cylinder via a third oil passage to raise an arm distal end of an arm that swingably supports a bucket proximal end of the bucket opposite to the bucket distal end;

controlling an arm control valve provided in the third oil passage to connect a part of the third oil passage from the first hydraulic pump to the arm control valve with a fourth oil passage connecting the arm control valve and a fourth chamber of the arm cylinder to send the hydraulic fluid from the first hydraulic pump to the fourth chamber of the arm cylinder to lower the arm distal end;

detecting an input of a first operation to raise the arm to an arm input member configured to be operated to raise and lower the arm;

detecting an input of a second operation to tilt the bucket downward to a bucket input member configured to be operated to swing the bucket; and sending, when the first operation and the second operation are detected, the hydraulic fluid to the first chamber through the first oil passage to control a switching mechanism to connect the first oil passage with the fourth oil passage through a bypass oil passage to send hydraulic fluid in the fourth chamber to the first chamber.

16. The control method according to claim 15, further comprising;

detecting an input of a third operation to tilt the bucket neither upward nor downward to the bucket input member; and controlling the switching mechanism, when the first operation and the third operation are detected, to cut off the part of the first oil passage and to connect the fourth oil passage with the first oil passage to send the hydraulic fluid in the fourth chamber to the first chamber.

17. The work machine according to claim 3, further comprising:

a first drain oil passage to connect the fourth oil passage with the hydraulic fluid tank when the first switching valve connects the arm control valve to the fourth chamber through the fourth oil passage, wherein the switching mechanism comprises a first counter balance valve provided in the first drain oil passage, a fourth switching valve, a third pilot oil passage connected to the fourth switching valve and the first pilot port of the first switching valve, a fourth pilot oil passage connecting the fourth switching valve with a part of the first drain oil passage that is provided between the first switching valve and the first counter balance valve, and a second drain oil passage connecting the fourth switching valve and the hydraulic fluid tank, wherein the fourth switching valve comprises a first connection port connected to the third pilot oil passage, a second connection port connected to the fourth pilot oil passage, a third connection port connected to the second drain oil passage, and a switching valve pilot port to which the pilot pressure is applied via the electromagnetic valve, and wherein, when a pilot oil pressure equal to or greater than a second threshold pressure is applied to the switching valve pilot port, the fourth switching valve is switched to a drain position at which the first connection port, the second connection port, and the third connection port communicates with each other, and when a pilot oil pressure less than the second threshold pressure is applied to the switching valve pilot port, the fourth switching valve is switched to a boost position at which the first connection port and communicates with second connection port and the third connection port is disconnected from the first connection port and the second connection port.

18. The work machine according to claim 4, further comprising:

a first drain oil passage to connect the fourth oil passage with the hydraulic fluid tank when the first switching valve connects the arm control valve to the fourth chamber through the fourth oil passage, wherein the switching mechanism comprises a first counter balance valve provided in the first drain oil passage, a fourth switching valve, a third pilot oil passage connected to the fourth switching valve and the first pilot port of the first switching valve, a fourth pilot oil passage connecting the fourth switching valve with a part of the first drain oil passage that is provided between the first switching valve and the first counter balance valve, and a second drain oil passage connecting the fourth switching valve and the hydraulic fluid tank, wherein the fourth switching valve comprises a first connection port connected to the third pilot oil passage, a second connection port connected to the fourth pilot oil passage, a third connection port connected to the second drain oil passage, and a switching valve pilot port to which the pilot pressure is applied via the electromagnetic valve, and wherein, when a pilot oil pressure equal to or greater than a second threshold pressure is applied to the switching valve pilot port, the fourth switching valve is switched to a drain position at which the first connection port, the second connection port, and the third connection port communicates with each other, and when a pilot oil pressure less than the second threshold pressure is applied to the switching valve pilot port, the fourth switching valve is switched to a boost position at which the first connection port and communicates with second connection port and the third connection port is disconnected from the first connection port and the second connection port.

19. The work machine according to claim 17, wherein the arm control valve further comprises a first arm control valve port connected to the first hydraulic pump via the third oil passage, a second arm control valve port connected to the fourth oil passage, a third arm control valve port connected to the third chamber of the arm cylinder via the third oil passage, and the arm control pilot port, wherein, when the arm input member is operated to raise the arm, the arm control valve is switched, according to the pilot pressure applied to the arm control pilot port, to an arm cylinder extension control position at which the first arm control valve port communicates with the third arm control valve port and communicating the second arm control valve port communicates with the first drain oil passage, wherein, when the arm input member is operated to lower the arm, the arm control valve is switched, according to the pilot pressure applied to the arm control pilot port, to an arm cylinder contraction control position at which the first arm control valve port communicates with the second arm control valve port and the third arm control valve port communicates with the first drain oil passage, and wherein, when the operation amount of the arm input member is smaller than a predetermined threshold amount, the arm control valve is switched, according to the pilot pressure applied to the arm control pilot port, to an arm cylinder static control position at which the first arm control valve port, the second arm control valve port, and the third arm control valve port are isolated.

20. The work machine according to claim 18, wherein the arm control valve further comprises a first arm control valve port connected to the first hydraulic pump via the third oil passage, a second arm control valve port connected to the fourth oil passage, a third arm control valve port connected to the third chamber of the arm cylinder via the third oil passage, and the arm control pilot port, wherein, when the arm input member is operated to raise the arm, the arm control valve is switched, according to the pilot pressure applied to the arm control pilot port, to an arm cylinder extension control position at which the first arm control valve port communicates with the third arm control valve port and communicating the second arm control valve port communicates with the first drain oil passage, wherein, when the arm input member is operated to lower the arm, the arm control valve is switched, according to the pilot pressure applied to the arm control pilot port, to an arm cylinder contraction control position at which the first arm control valve port communicates with the second arm control valve port and the third arm control valve port communicates with the first drain oil passage, and wherein, when the operation amount of the arm input member is smaller than a predetermined threshold amount, the arm control valve is switched, according to the pilot pressure applied to the arm control pilot port, to an arm cylinder static control position at which the first arm control valve port, the second arm control valve port, and the third arm control valve port are isolated.

* * * * *